US005749821A

United States Patent [19]

Simmons

[11] Patent Number: 5,749,821

[45] Date of Patent: May 12, 1998

[54] CUSHIONING CONVERSION SYSTEM FOR CONVERTING PAPER STOCK INTO CUSHIONING MATERIAL WITH A STAGING AREA AND A PICK AND PLACE ASSEMBLY

[75] Inventor: James A. Simmons, Painsville Township, Ohio

[73] Assignee: Ranpak Corp., Concord, Ohio

[21] Appl. No.: 505,108

[22] Filed: Jul. 21, 1995

[51] Int. Cl.[6] ..... B31B 1/00

[52] U.S. Cl. ..... 493/3; 493/12; 493/464; 493/967; 198/464.2; 198/572

[58] Field of Search ..... 493/3, 9, 10, 11, 493/13, 14, 17, 18, 19, 20, 25, 29, 33, 352, 464, 967, 8, 12, 15, 16, 27, 22, 34, 493; 198/464.2, 464.3, 572

[56] References Cited

U.S. PATENT DOCUMENTS

| | | | |
|---|---|---|---|
| 2,101,170 | 12/1937 | Engel . | |
| 2,882,802 | 4/1959 | Walker . | |
| 3,266,794 | 8/1966 | Weir . | |
| 3,509,797 | 5/1970 | Johnson . | |
| 3,603,216 | 9/1971 | Johnson . | |
| 3,621,981 | 11/1971 | Nimmo | 198/460 |
| 3,695,133 | 10/1972 | Finke . | |
| 3,784,071 | 1/1974 | Milan | 266/1 |
| 4,026,198 | 5/1977 | Ottaviano . | |
| 4,073,375 | 2/1978 | Hart et al. | 198/460 |
| 4,085,662 | 4/1978 | Ottaviano . | |
| 4,085,928 | 4/1978 | Sussman | 493/14 |
| 4,109,040 | 8/1978 | Ottaviano | 428/129 |
| 4,237,776 | 12/1980 | Ottaviano . | |
| 4,355,712 | 10/1982 | Bruno | 198/460 |
| 4,385,537 | 5/1983 | Wolf | 83/100 |
| 4,488,846 | 12/1984 | Halberschmidt et al. | 414/152 |
| 4,557,716 | 12/1985 | Ottaviano | 493/464 |
| 4,588,884 | 5/1986 | Priscott | 250/223 R |
| 4,619,635 | 10/1986 | Ottaviano . | |
| 4,641,271 | 2/1987 | Konishi et al. | 364/478 |
| 4,697,485 | 10/1987 | Raney | 83/34 |
| 4,699,609 | 10/1987 | Komoronsky et al. . | |
| 4,717,613 | 1/1988 | Ottaviano . | |
| 4,746,255 | 5/1988 | Roccabianca | 414/84 |
| 4,750,896 | 6/1988 | Komoronsky et al. . | |
| 4,839,210 | 6/1989 | Komoronsky et al. . | |
| 4,884,999 | 12/1989 | Baldacci . | |
| 4,925,005 | 5/1990 | Keller | 198/460 |
| 4,949,607 | 8/1990 | Yuito | 83/76.7 |
| 4,968,291 | 11/1990 | Baldacci et al. . | |
| 4,987,809 | 1/1991 | Price | 83/27 |
| 5,088,972 | 2/1992 | Parker . | |
| 5,092,450 | 3/1992 | Schommartz | 198/460 |
| 5,097,939 | 3/1992 | Shanklin | 198/460 |
| 5,123,889 | 6/1992 | Armington et al. . | |
| 5,285,887 | 2/1994 | Hall | 198/460 |

FOREIGN PATENT DOCUMENTS

| | | |
|---|---|---|
| 0388121 | 3/1990 | European Pat. Off. . |
| 8304401 | 12/1983 | WIPO . |
| 9513914 | 5/1995 | WIPO . |

*Primary Examiner*—Jack W. Lavinder
*Assistant Examiner*—Christopher W. Day
*Attorney, Agent, or Firm*—Renner, Otto, Boisselle & Sklar

[57] ABSTRACT

A cushioning conversion system includes a cushioning conversion machine which converts stock paper into cut pads, a conveyor system positioned to receive a pad produced by the cushioning conversion machine and to move the pad to a staging area, the staging area including a sensor for sensing the presence of a pad in the staging area and generating a representative signal, and a pad retrieval system for retrieving the pad from the staging area, wherein the cushioning conversion machine produces a pad when the representative signal indicates that a pad is not present in the staging area and the retrieval system retrieves a pad when the representative signal indicates a pad is in the staging area.

6 Claims, 7 Drawing Sheets

CUSHIONING CONVERSION SYSTEM FOR CONVERTING PAPER STOCK INTO CUSHIONING MATERIAL WITH A STAGING AREA AND A PICK AND PLACE ASSEMBLY

FIELD OF THE INVENTION

This invention relates generally to a cushioning conversion system which converts paper stock into cushioning material, and more particularly, to a cushioning conversion system which produces a cushioning product and automatically places the cushioning product into a container.

BACKGROUND OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials have made paper protective packaging material a very popular alternative. Paper is biodegradable, recyclable and renewable; making it an environmentally responsible choice for conscientious companies.

While paper in sheet form could possibly be used as a protective packaging material, it is usually preferable to convert the sheets of paper into a low density cushioning product. This conversion may be accomplished by a cushioning conversion machine, such as those disclosed in U.S. Pat. Nos. 4,026,198; 4,085,662; 4,109,040; 4,237,776; 4,557,716; 4,650,456; 4,717,613; 4,750,896; and 4,968,291. (These patents are all assigned to the assignee of the present invention and their entire disclosures are hereby incorporated by reference.) Such a cushioning conversion machine converts sheet-like stock material, such as paper in multi-ply form, into low density cushioning pads or dunnage.

A cushioning conversion machine, such as those disclosed in the above-identified patents, may include a stock supply assembly, a forming assembly, a gear assembly, and a cutting assembly, all of which are mounted on the machine's frame. During operation of such a cushioning conversion machine, the stock supply assembly supplies the stock material to the forming assembly. The forming assembly causes inward rolling of the lateral edges of the sheet-like stock material to form a continuous strip having lateral pillow-like portions and a thin central band. The gear assembly, powered by a feed motor, pulls the stock material through the machine and also coins the central band of the continuous strip to form a coined strip. The coined strip travels downstream to the cutting assembly which cuts the coined strip into pads of a desired length.

Typically, the cut pad is transferred downstream to a transitional zone, such as a table, a conveyor, a bin, etc., where the pad is stored. Thereafter an operator would manually remove the pad from the transitional zone and manually insert the pad within a container for cushioning purposes. It would be desirable to automate the process of placing the pad into the container.

SUMMARY OF THE INVENTION

The present invention provides a cushioning conversion system including a cushioning conversion machine and a pick and place assembly which produces pads of the desired length and automatically places the pads into a container or onto a container material. The cushioning conversion machine preferably communicates signals generated by sensors which indicate to the pick and place assembly the presence of a pad of the desired length in a transitional zone from which the pick and place assembly can retrieve the pad.

In accordance with one embodiment of the invention, a cushioning conversion system includes a cushioning conversion machine which converts stock paper into cut pads, a conveyor system positioned to receive a pad produced by the cushioning conversion machine and to move the pad to a staging area, the staging area including a sensor for sensing the presence of a pad in the staging area and generating a representative signal, and a pad retrieval system for retrieving the pad from the staging area, wherein the cushioning conversion machine produces a pad when the representative signal indicates that a pad is not present in the staging area and the retrieval system retrieves a pad when the representative signal indicates a pad is in the staging area.

In accordance with a further embodiment of the invention, a cushioning conversion system includes a cushioning conversion machine which converts stock paper into cut pads, a conveyor system positioned to receive a pad produced by the cushioning conversion machine and to move the pad to a staging area, and a retrieval system for retrieving the pad from the staging area.

In general, the invention comprises the foregoing and other features hereinafter fully described and particularly pointed out in the claims, the following description and the annexed drawings setting forth in detail a certain illustrated embodiment of the invention, this being indicative, however, of but one of the various ways in which the principles of the invention may be employed.

DETAILED DESCRIPTION OF THE INVENTION

Figure 1:
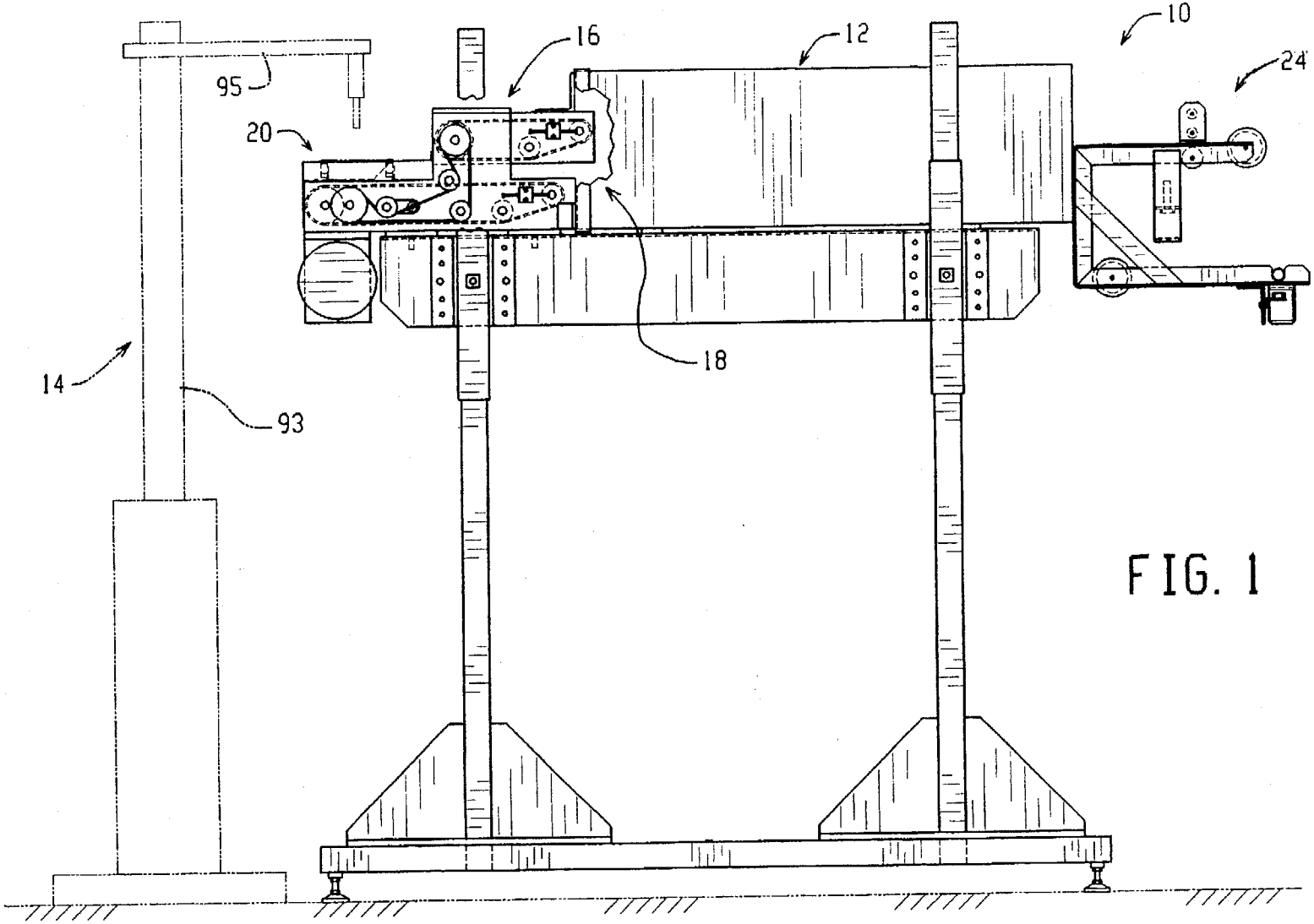
FIG. 1 is an elevation view of a cushioning conversion system of the present invention including a cushioning conversion machine and a pick and place apparatus.
Figure 2:
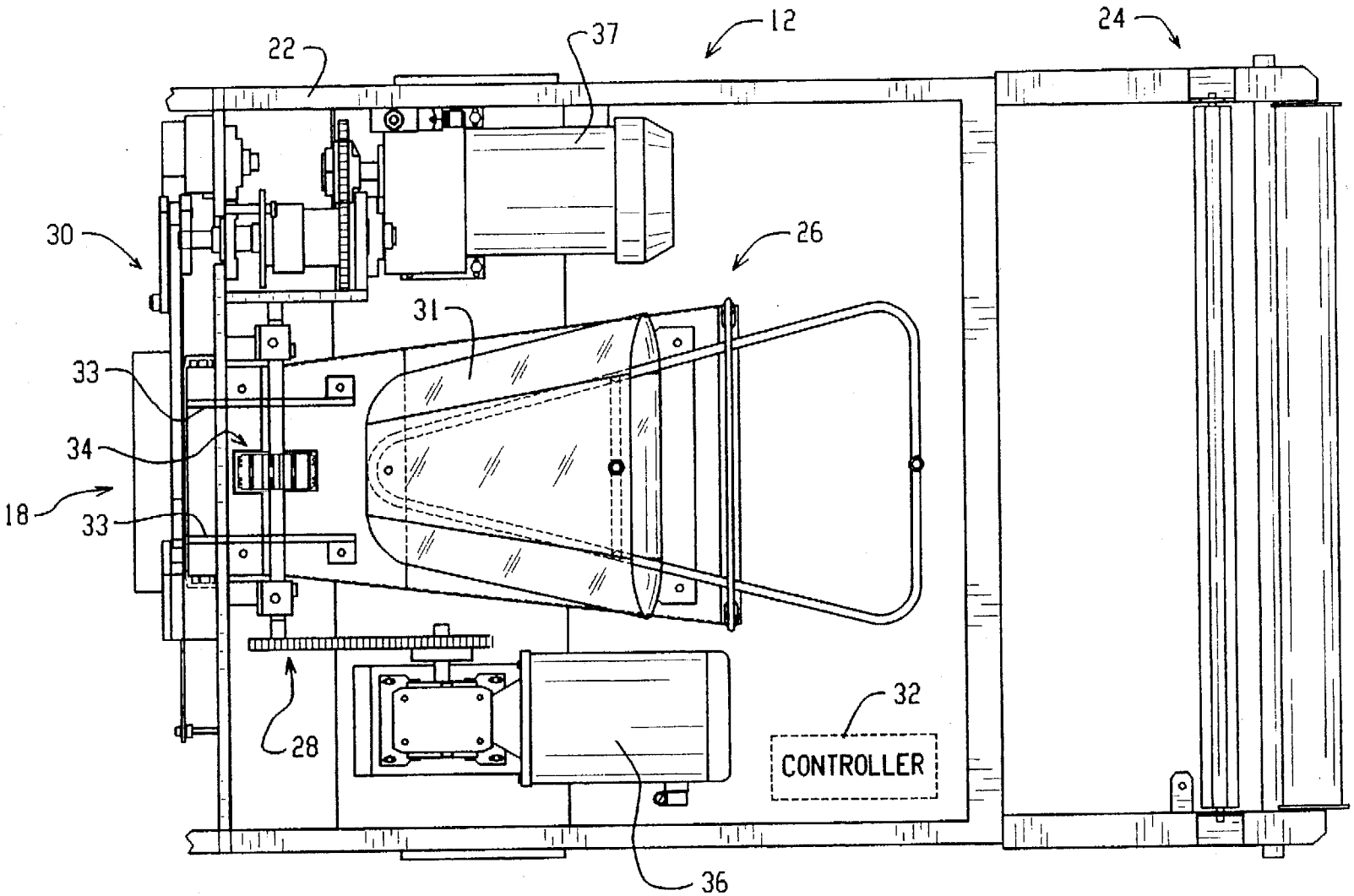
FIG. 2 is top partial view of the cushioning conversion machine.
Figure 3:
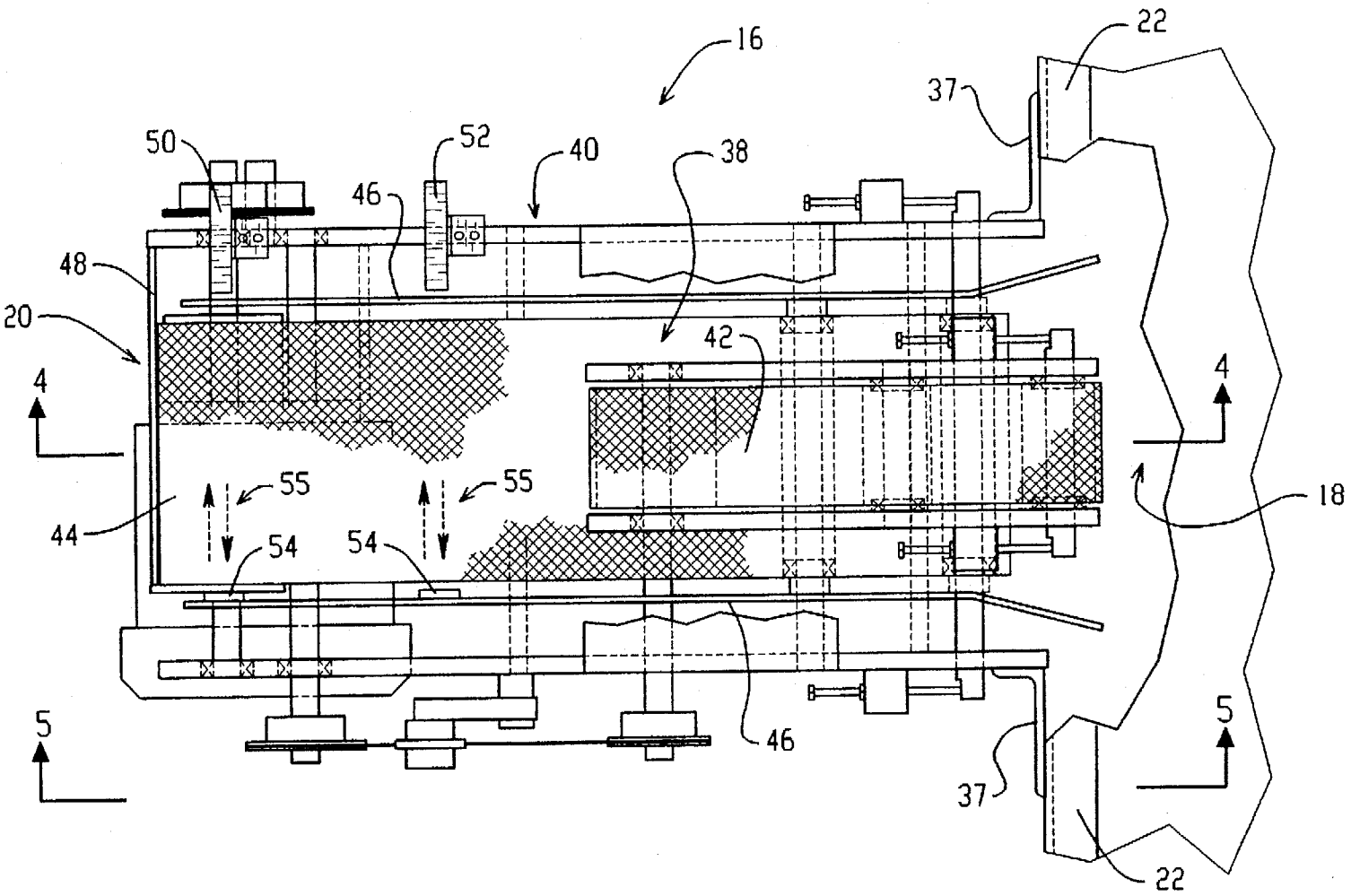
FIG. 3 is a partial close-up view of the conveyor assembly of the cushioning conversion machine.

With reference to the drawings and initially to FIGS. 1 and 2, there is shown a cushion conversion system 10 including a cushioning conversion machine 12 for producing a cushioning product, such as a pad, and a pad retrieval apparatus 14 for automatically removing the pad from the machine and transferring the pad to a second location, such as in a container. The machine 12 includes pad conveyor assembly 16 which conveys the pad from the machine exit 18 after being formed and cut to a staging location 20 from which the pad retrieval apparatus 14, such as a pick and place apparatus, can retrieve the pad and place it in a container to provide product cushioning.

The cushioning conversion machine 12 additionally includes a frame 22 by which are supported the various components for converting stock material, such as kraft paper, to a strip of cushioning product and cutting the strip into pads of the desired length. Such components include a stock supply assembly 24, a forming assembly 26 for forming the stock material into the strip of cushioning product, a feed assembly 28 for feeding stock material through the forming assembly and a cutting assembly 30 which cuts the strip of cushioning product into pads of a desired length. These components and their functioning are described more fully in U.S. patent application Ser. No. 08/188,305, which is incorporated herein through this reference. However, it is noted that in some applications of the present invention it may be desired that the chute 31 of the forming assembly 26 have a smaller outlet to produce a denser, narrower pad, for example, a pad being 25 to 30 percent denser and generally six inches wide as opposed to eight to nine inches wide. In such an instance it is also preferable to provide a pair of constraining rails 31 narrowing the width of the area in the vicinity of the feed assembly 28 to prevent the pad from expanding to greater than the desired width. Preferably operation of the feed assembly 28 and the cutting assembly 30 are controlled by a controller (shown schematically at 32), such as the controller described in co-owned U.S. patent application Ser. Nos. 08/279,149 and 08/482,015 which are incorporated herein by this reference.

During the conversion process, the feed assembly 28 draws the continuous strip of stock material from the stock supply assembly 24 and through the forming assembly 26 by the action of two cooperating and opposed gears 34 which are rotated through power supplied by the feed motor 36. As the strip of stock material is drawn through the forming assembly 26, the forming assembly causes the lateral edges of the stock material to roll inwardly to form a continuous strip having two lateral pillow-like portions and a central band therebetween. The opposed gears 34 of the feed assembly 28 additionally perform a "coining" or "connecting" function as the gears coin the central band of the continuous strip as it passes through the nip of the gears to form a coined strip. As the coined strip travels downstream from the feed assembly 28, the cutting assembly 30, powered by the cut motor 37, cuts the strip into sections or pads of a desired length. These cut sections are then conveyed from the machine exit 18 to the staging area 20 where they await retrieval and placement by the pick and place apparatus 14.

The pad conveyor assembly 16 which conveys the cut pads away from the machine exit 18 is shown in detail in FIGS. 3 through 6. The pad conveyor assembly 16 is positioned adjacent the exit 18 of the cushioning conversion machine 12 to receive a cut pad and is preferably mounted to the machine frame 22 such as by mounting flanges 37. The pad conveyor assembly 16 includes an upper conveyor belt assembly 38 and a lower conveyor belt assembly 40. The upper and lower conveyor belt assemblies 38, 40 each include a conveyor belt 42, 44, respectively, which confront each other and are spaced to gently compress and frictionally engage the cut pad therebetween to transfer the pad from the machine exit 18 to the staging area 20. Preferably, the pad contacts at least one of the conveyor belts 42, 44 prior to or immediately after being cut by the cutting assembly 30 so that the cut pad is immediately moved from the machine exit 18 to the staging area 20. The conveyor belts 42 and 44 may be one of many suitable types and finishes with a coefficient of friction between the conveyor belt and the pad so as to cause the pad to move along with the conveyors while permitting the pad to slide relative to the conveyor 44 in the staging area 20 prior to being retrieved by the pick and place assembly 14 without damage to the pad.

The upper conveyor belt assembly 38 extends from the machine exit 18 along approximately one-half of the length of the lower conveyor belt assembly 40 thus providing the staging area 20 as the open area between the end of the upper conveyor assembly 38 and the end of the lower conveyor assembly 40 accessible from above by the pick and place assembly 14 (FIG. 1). A pair of rails 46 disposed on either lateral side of the lower conveyor belt 44 confines the pad 45 to a space on the lower conveyor belt and prevents the pad from leaving the area of the conveyor belt or becoming jammed. The rails preferably diverge toward the machine exit 18 to form an area which acts to channel the pad 45 between the conveyor belts 42 and 44. A stop 48 positioned at the end of the lower conveyor assembly 40 prohibits the cut pad 45 from moving beyond the end of the lower conveyor 44. The side rails 46 and the stop 48 cooperate to maintain the pad 45 in the staging area 20 at a known location until it can be retrieved by the pick and place assembly 14.

Figure 6:
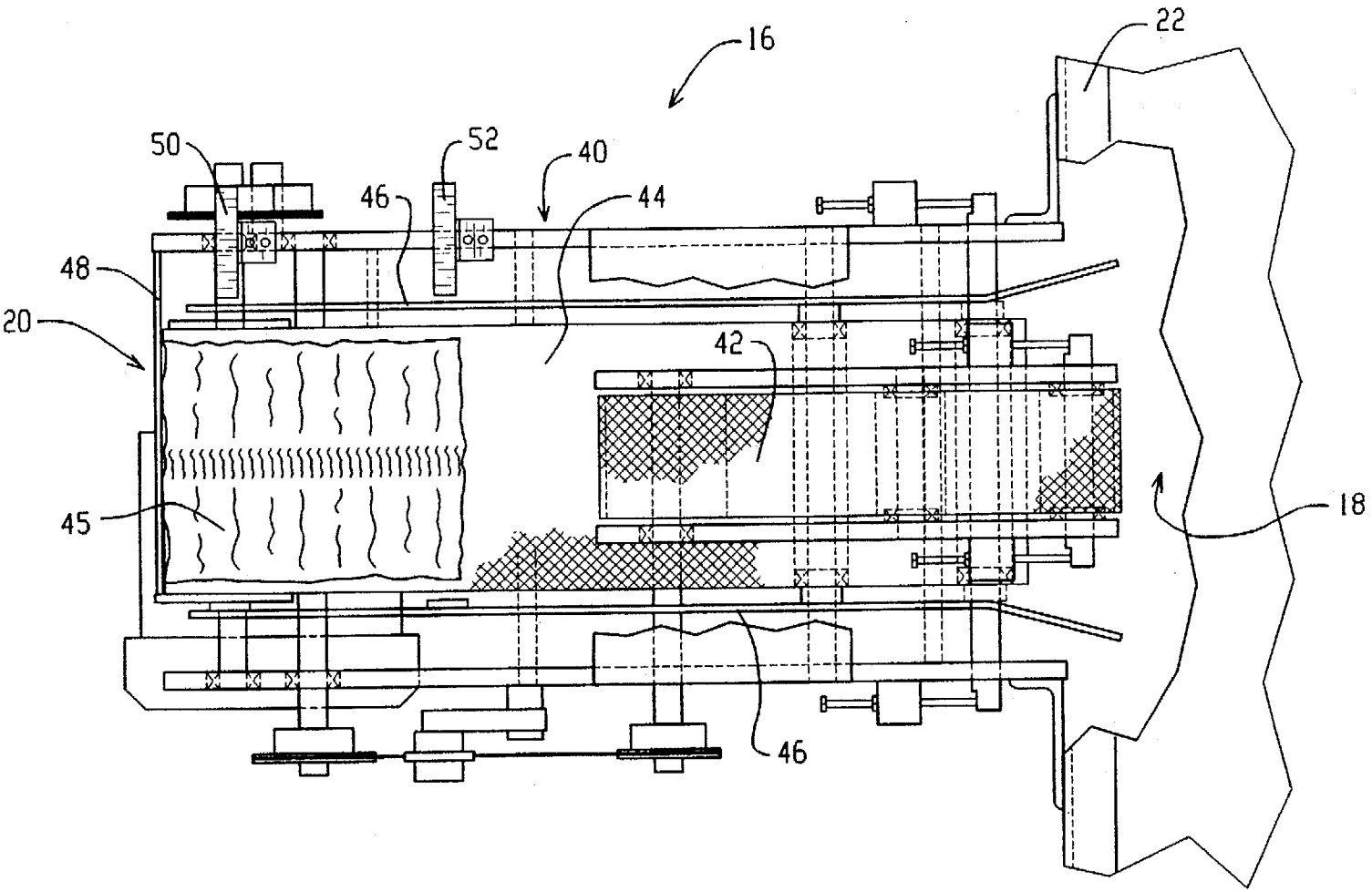
FIG. 6 is a top view of the conveyor assembly with a pad in the staging area.

Located near the distal end of the lower conveyor belt assembly 40 are a pair of sensors 50 and 52 for determining the presence of a pad 45 in the staging area 20 as well as determining whether the pad is of the appropriate length. The sensors 50, 52 are preferably standard photoelectric sensors capable of both transmitting and receiving an optical signal to detect the presence or absence of an object. Associated with each sensor is a retroreflector 54 positioned across the lower conveyor belt 44 from the associated sensor. The sensor 50 is located near the stop 48 and detects the presence of a pad in the staging area 20 when the optical path 55 between the sensor 50 and associated retroreflector 54 is interrupted by the pad. The sensor 52 is located upstream of the stop 48 by a distance slightly less than the desired length of pad to be produced by the cushioning conversion machine 12. When a pad of an appropriate length is in the staging area 20 the optical path 55 between the sensor 52 and associated retroreflector 54 will be interrupted by the trailing portion of the pad, as is shown in FIG. 6. When the optical paths 55 of the optical signals generated by sensors 50 and 52 are both interrupted, the pad 45 is known to be in the staging area 20 and to be of at least the desired length. Output signals from the sensors 50 and 52 indicative of the detection of a pad and of the detection of a pad of a certain length are provided to the controller 32, shown in FIG. 2.

The controller 32 controls the feed motor 36 powering the feed assembly 28 as a function of the output signals received from the sensors 50 and 52 as well as other inputs to the controller. For example, while either sensor 50 or 52 is indicating the presence of a pad in the staging area 20 the controller 32 will prevent the feed motor 36 from operating thus preventing the machine from producing another pad. In the event that neither sensor 50 or 52 detects the presence of a pad in the staging area 20 the controller 32 may then instruct the feed motor 36 to operate for the appropriate length of time to produce a pad of the desired length. The controller 32 will then wait until this pad has been removed from the staging area 20, such as by the pick and place apparatus 14, as indicated by the sensors 50 and 52 before it instructs the feed motor 36 to feed another pad through the machine. In such a way, pads are produced only as needed and problems associated with pads accumulating in a transitional area are eliminated.

Figure 4:
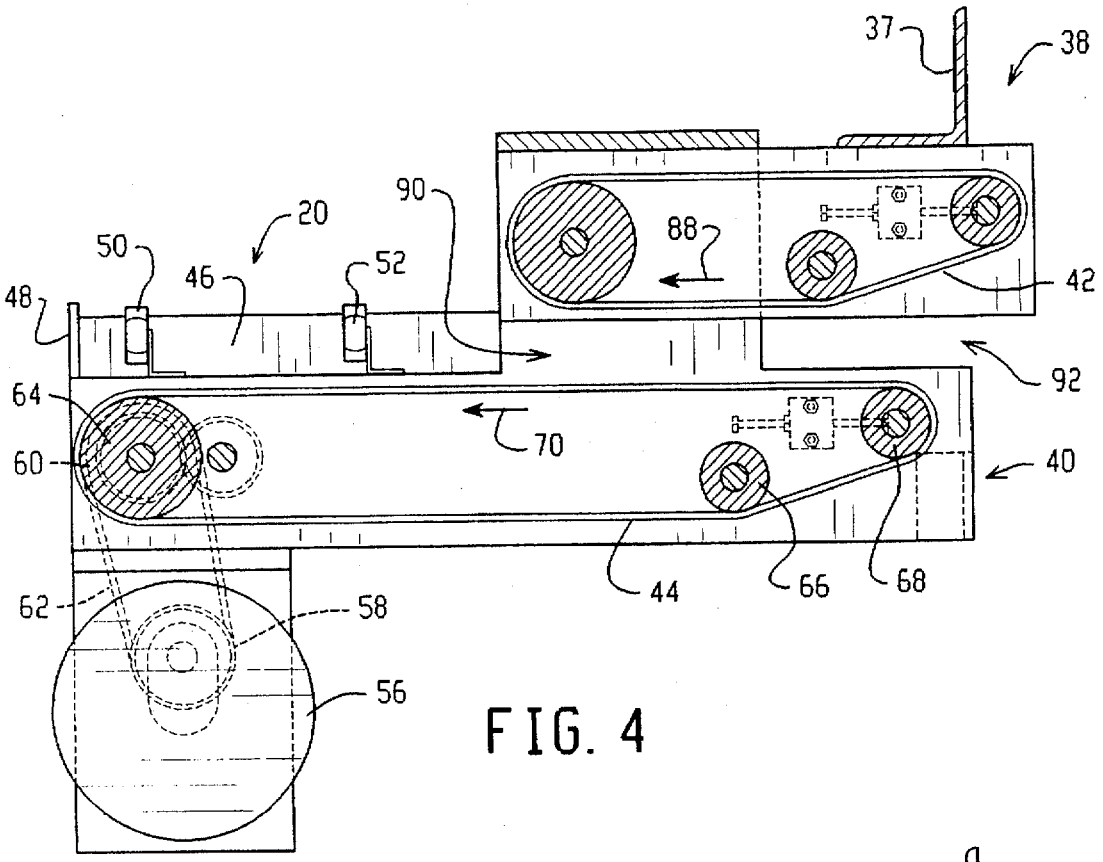
FIG. 4 is a cross-sectional view of the conveyor assembly of FIG. 3 taken generally along the line 4—4 in FIG. 3.
Figure 5:
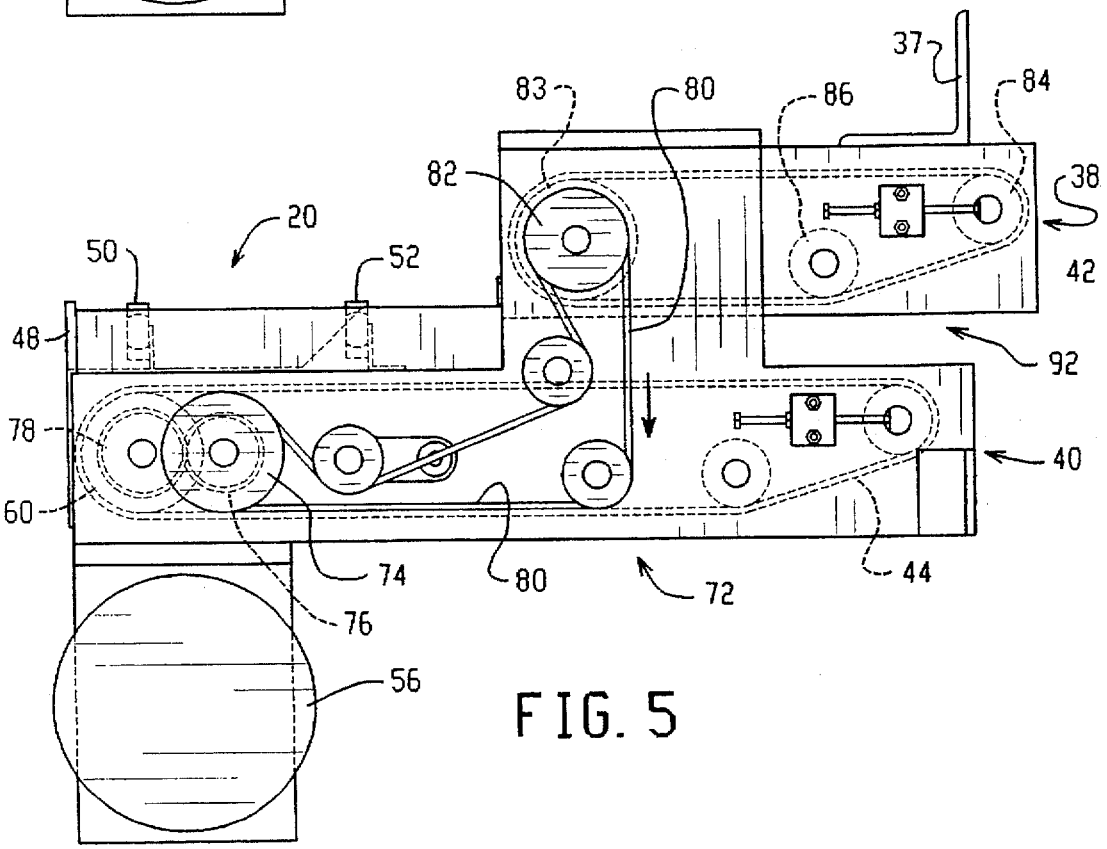
FIG. 5 is a view of the side of the conveyor assembly taken along the line 5—5 in FIG. 3.

The pad conveyor assembly 16 includes a conveyor motor 56 which rotates a pulley 58, as shown in FIG. 4, which in turn powers a drive pulley 60 of the lower conveyor assembly 40 through a belt 62. A drive roller 64 rotating with the pulley 60 provides power to the conveyor belt 44 which follows along drive roller 64 and a path defined by rollers 66 and 68 located near the opposite end of the conveyor assembly 40 in the direction of the arrow 70. A secondary pulley and belt assembly 72 provides power to move the conveyor belt 42 of the upper conveyor assembly 38, as shown in FIG. 5. The secondary pulley and belt assembly 72 includes a pulley 74 having a coaxial gear 76 which is meshed with a gear 78 coaxial with the drive pulley 60. Consequently, the rotational motion of the drive pulley 60 is transferred to the pulley 74 causing the pulley 74 to rotate in the opposite direction of the drive pulley 60. A belt 80 transfers the rotational movement of the pulley 74 to the drive pulley 82 and attached drive roller 83 of the upper conveyor assembly 38 which in turn powers the conveyor belt 42 along a path defined by the additional rollers 84 and 86. In this way, the lower portion of the conveyor belt 42 travels in the direction of the arrow 88 and in the same direction as the upper portion of the conveyor belt 44. Consequently, a pad located in the area 90 formed between the conveyors 42 and 44 will progress away from the exit 18 of the cushioning conversion machine 12 towards the staging area 20. Preferably, the space 90 formed between the conveyors 42 and 44 is divergent in an area 92 confronting the exit 18 of the cushioning conversion machine 12 to guide a formed pad into the space 90 between the conveyors.

The pick and place assembly 14, as shown in FIG. 1, may be embodied through any number of ways as will be apparent to a person skilled in the art. For example, the pick and place assembly 14 may include a shaft 93 which is vertically and rotationally movable and an arm 95 including a projection which picks up the pad 45 from the staging area such as through the use of a vacuum or other means. The pick and place assembly 14 is provided with signals from one or both of the sensors 50 and 52 or a composite signal indicating that a pad of an appropriate length has been detected. The signals or a composite signal may be provided directly from the sensors 50 and 52 or preferably from the controller 32 after a short time delay to ensure the authenticity of the signals. The controller 32 may also provide other relevant information to the pick and place assembly 14. The pick and place assembly 14 will retrieve the formed pad 45 from the staging area 20 once it has received the appropriate signal that a pad of the appropriate length is present in the staging area and deposit the pad in the desired location, such as directly into a container.

The cushioning conversion machine 12 and the pick and place assembly 14 thus cooperate to provide a cushioning conversion system 10 that forms one pad at a time and retrieves the individual pads as they are formed for placement into a container.

Figure 7:
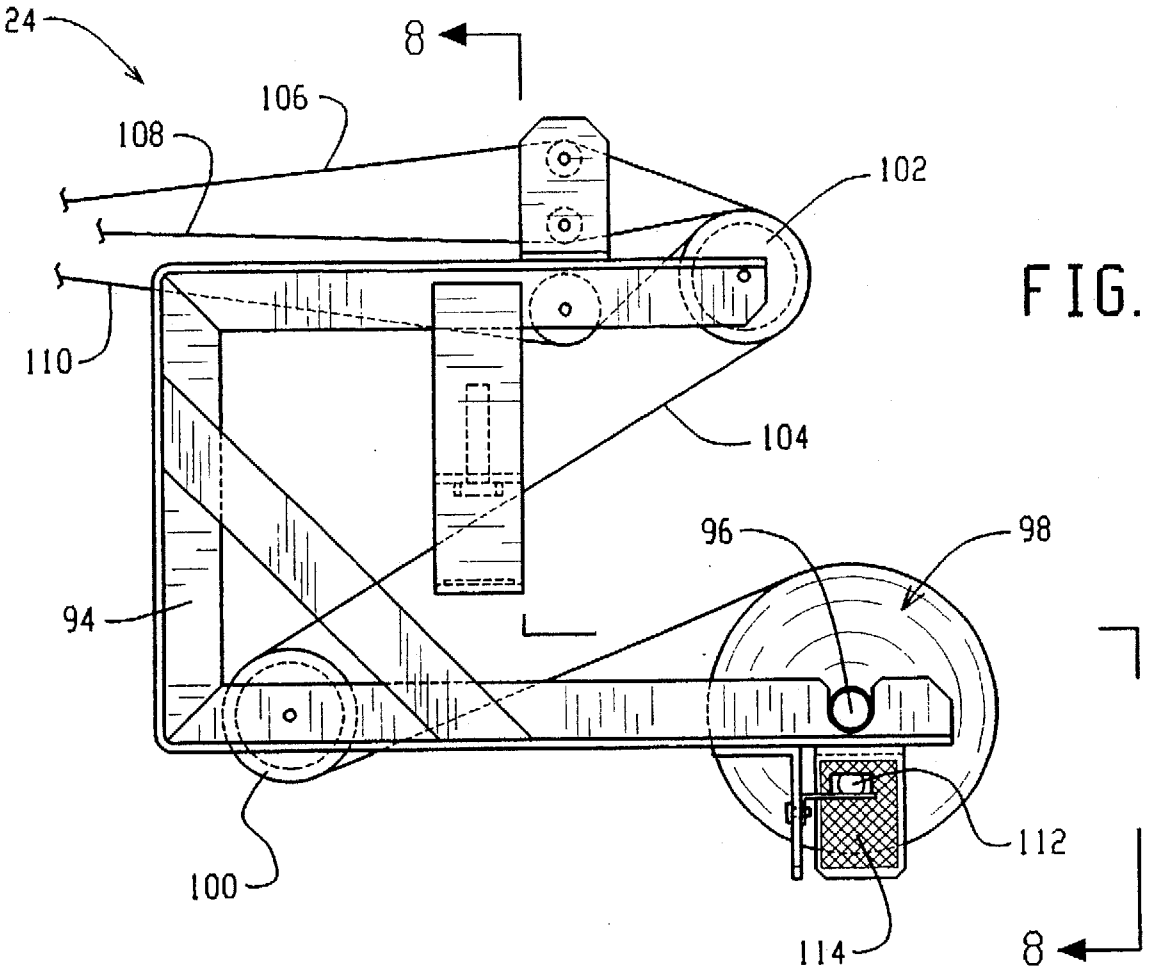
FIG. 7 is a side view of the stock supply assembly of the cushioning conversion machine.
Figure 8:
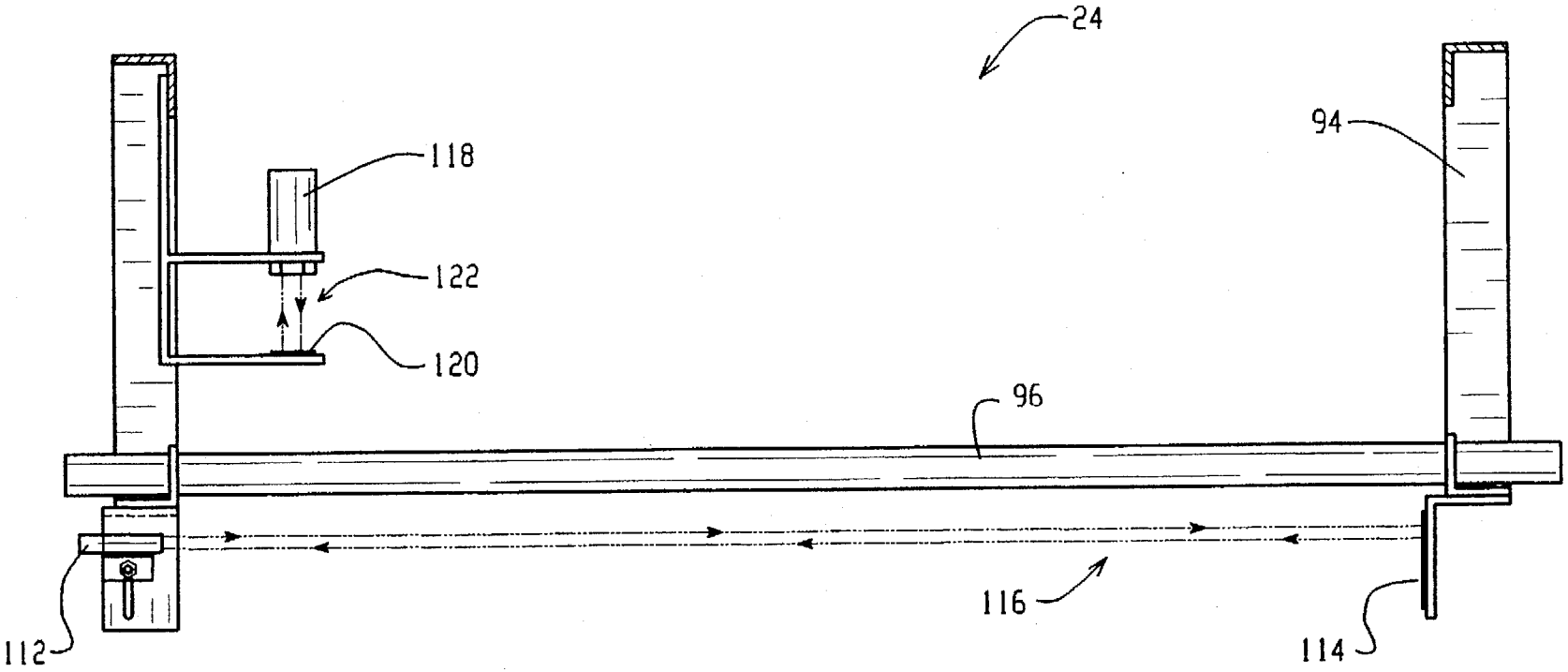
FIG. 8 is an elevation view of the stock supply assembly taken along the line 8—8 in FIG. 7.

Referring to FIGS. 7 and 8 there is shown the stock supply assembly 24 from which supplies the stock material converted into pads by the cushioning conversion machine 12. The stock supply assembly 24 includes a frame 94 which supports a supply shaft 96 which in turn supports a roll of stock material 98 (shown schematically) and a number of rollers 100, 102 for directing the stock material 104 to the forming assembly 26 and for separating the multiple plies 106, 108, 110 of the stock material prior to being formed into a pad. (For clarity, in FIG. 8 the stock material and stock roll are not shown.)

Mounted to the frame 94 at opposite ends of the supply shaft 96 are a photoelectric sensor 112 and retroreflector 114 for detecting when the amount of remaining stock material on the roll 98 has become low. The low stock level sensor 112 is positioned at a radial distance from the shaft 96 and directs an optical signal towards the retroreflector 114 which, in the absence of an object lying in the optical path 116, is directed back to the sensor for detection by the sensor. When a partially full roll of stock supply material 98 is on the shaft 96, it interrupts the optical path and thus can be detected by the sensor. When the amount of stock material on the roll 98 becomes low, the diameter of the stock roll becomes small and ceases to interrupt the optical path 116, allowing for the detection by the sensor 112 of the low level of stock material available. The sensor 112 generates a signal which is supplied to the controller 32 (FIG. 2) indicating whether the supply of stock material is below a determined level.

A separate photoelectric sensor 118 and corresponding retroreflector 120 are also mounted to the frame 94 for detecting the end of the stock material or end of web. The sensor 118 is positioned at a location between the stock supply roll 98 and the forming assembly 26, and preferably between the rollers 100 and 102 such that the stock material 104 is fed between the sensor 118 and retroreflector 120. When the end of the stock web has not yet passed the sensor 118, the optical signal generated by the sensor 118 and transmitted to the retroreflector and reflected back along the path 122 is interrupted, thus permitting the sensor to detect the presence of the stock material 104. When the stock supply has become exhausted and the end of the stock material has passed the sensor 118, the optical signal generated by the sensor will be reflected back by the retroreflector and the sensor will thus detect the absence of the stock material in the optical path 122. A signal indicating whether the end of the stock material has been detected is supplied to the controller 32 (FIG. 2).

The signals generated by the sensors 112 and 118 may be used by the controller 32 to discontinue operation of the feed motor 36 when the end of the stock material has been detected or to provide a visual indication of whether the machine 12 has run out of stock material or is low on stock material. The visual indication may be a number of lamps, such as a green lamp to indicate that the machine is not low on stock material, a yellow lamp to indicate that the supply of stock material is low and a red light to indicate that the machine is out of stock, or some other visual arrangement. Preferably the controller 32 also detects the operational status of machine and may also indicate the proper or fault status of the machine through the green and red lamps.

While the cushioning conversion system has been described relative to a number of specific embodiments, it will be readily apparent that the present invention has a wide range of applications to many different types of cushioning conversion machines and embodiments of pad retrieval apparatus.

What is claimed is:

1. A cushioning conversion system, comprising:

a cushioning conversion machine including a conversion assembly which converts stock paper into pads;

a conveyor system positioned to receive a pad produced by the cushioning conversion machine and to move the pad to a staging area, the staging area including a first sensor for sensing a presence or absence of a pad in the staging area and generating a representative signal in response to the sensing;

a pick and place assembly for retrieving the pad from the staging area; and a controller which receives the representative signal regarding the presence or absence of a pad in the staging area from the first sensor and which controls the operation of the cushioning conversion machine to produce a pad when a pad is absent from the staging area and controls the pick and place assembly to obtain a pad from the staging area when a pad is present in the staging area.

2. The system of claim 1, including a second sensor located upstream of the first sensor for detecting the presence of a pad in the staging area of at least a certain length.

3. The system of claim 2, wherein the retrieval system retrieves a pad from the staging area when both the first and second sensors indicate the presence of a pad in the staging area.

4. The system of claim 1, including a stop at the end of the conveyor system opposite the cushioning conversion machine.

5. The system of claim 1, wherein the conveyor system includes a conveyor belt.

6. The system of claim 1, wherein the conveyor system includes a pair of conveyor belts of unequal lengths spaced to accept a pad therebetween.

* * * * *